US010662557B2

(12) United States Patent
Zenoni et al.

(10) Patent No.: US 10,662,557 B2
(45) Date of Patent: May 26, 2020

(54) METHOD FOR CONTROLLING THE CONSUMPTION OF YARN IN A WEAVING PROCESS

(71) Applicant: L.G.L. ELECTRONICS S.p.A., Gandino (IT)

(72) Inventors: Pietro Zenoni, Leffe (IT); Luca Gotti, Albino (IT)

(73) Assignee: L.G.L. ELECTRONICS S.P.A., Gandino (IT)

( * ) Notice: Subject to any disclaimer, the term of this patent is extended or adjusted under 35 U.S.C. 154(b) by 50 days.

(21) Appl. No.: 16/142,264

(22) Filed: Sep. 26, 2018

(65) Prior Publication Data

US 2019/0106818 A1 Apr. 11, 2019

(30) Foreign Application Priority Data

Oct. 10, 2017 (IT) ..... 102017000113434

(51) Int. Cl.
*D03D 49/12* (2006.01)
*D03D 51/44* (2006.01)
(Continued)

(52) U.S. Cl.
CPC ..... *D03D 51/44* (2013.01); *D03D 51/34* (2013.01); *D03J 1/00* (2013.01); *D04B 15/482* (2013.01);
(Continued)

(58) Field of Classification Search
CPC ..... B65H 51/30; B65H 59/06; B65H 59/387; B65H 63/02; B65H 63/04; B65H 59/388;
(Continued)

(56) References Cited

U.S. PATENT DOCUMENTS 4,298,172 A * 11/1981 Hellstrom ..... B65H 51/30 139/452
4,799,517 A * 1/1989 Bucher ..... D03D 47/361 139/452
(Continued)

FOREIGN PATENT DOCUMENTS

EP 2270269 A1 1/2011
EP 2415916 A1 2/2012
EP 3103749 A1 12/2016

OTHER PUBLICATIONS

IT Search Report dated Jun. 12, 2018 re: Application No. IT 2017000113434, pp. 1-7, citing: EP 3 103 749 A1, EP 2 415 916 A1, EP 2 270 269 A1 and US 5 058 398 A.

*Primary Examiner* — Robert H Muromoto, Jr.
(74) *Attorney, Agent, or Firm* — Cantor Colburn LLP

(57) ABSTRACT

A textile machine receives a plurality of yarns from respective feeders, each provided with a control unit that calculates, for each garment produced, the amount of yarn consumed (YCmeas) and compares it with a reference consumption value (YCref). If the difference exceeds a preset limit value (% max) that indicates an anomaly, then an alarm is generated. Periodically, the control unit calculates an average consumption value (YCmed) on the basis of a preset number (Nmed) of already-finished garments, and compares it with the reference consumption value (YCref). If the difference exceeds a preset threshold value (% maxmed), then the reference consumption value (Yref) is set to the average consumption value (Ymed).

8 Claims, 2 Drawing Sheets

(51) Int. Cl.

| | |
|---|---|
| ***D03J 1/00*** | (2006.01) |
| ***D03D 51/34*** | (2006.01) |
| ***D04B 15/48*** | (2006.01) |
| ***D04B 35/12*** | (2006.01) |
| *D03D 1/00* | (2006.01) |

(52) U.S. Cl.
CPC ..... *D04B 35/12* (2013.01); *D03D 2700/265* (2013.01); *D03D 2700/313* (2013.01); *D03J 2700/06* (2013.01)

(58) Field of Classification Search
CPC ..... B65H 63/00; D04B 35/12; D04B 15/486; D04B 15/48; D04B 15/66; D04B 15/99; D04B 15/44; D03D 47/367; D03D 47/361; D03D 47/364
See application file for complete search history.

(56) References Cited

U.S. PATENT DOCUMENTS 4,984,749 A * 1/1991 Matsui ..... B65H 63/00 242/410
5,058,398 A 10/1991 Memminger et al.
5,119,998 A * 6/1992 Tholander ..... D03D 47/367 242/364.8
5,323,324 A * 6/1994 Fredriksson ..... G05B 19/0421 700/130
8,170,710 B2 * 5/2012 Barea ..... D04B 35/12 700/141
8,175,740 B2 * 5/2012 Lamprillo ..... B65H 59/06 700/130
8,340,805 B2 * 12/2012 Zenoni ..... D04B 35/12 700/141
8,397,582 B2 * 3/2013 Zenoni ..... D04B 15/486 73/783
2008/0210800 A1 * 9/2008 Lamprillo ..... B65H 59/06 242/150 R
2008/0237385 A1 * 10/2008 Lassmann ..... D01H 4/00 242/473.4
2009/0139271 A1 * 6/2009 Barea ..... D04B 35/12 66/125 R
2011/0000306 A1 * 1/2011 Zenoni ..... D04B 15/486 73/783
2012/0031148 A1 * 2/2012 Zenoni ..... D04B 15/486 66/163
2013/0056573 A1 * 3/2013 Barea ..... B65H 51/30 242/420.5

* cited by examiner

METHOD FOR CONTROLLING THE CONSUMPTION OF YARN IN A WEAVING PROCESS

CROSS-REFERENCE TO RELATED APPLICATIONS

This application is related to, and claims the benefit of, Italian Patent Application No. 102017000113434, filed on Oct. 10, 2017, the contents of which are herein incorporated by reference in their entirety.

TECHNICAL FIELD

The present disclosure relates to a method for controlling the consumption of yarn m a weaving process.

BACKGROUND

As is known, in a weaving process a textile machine, e.g., a knitting machine, receives a plurality of yarns from respective feeders.

The yarn consumed in order to make the individual garments can be constantly monitored for the purpose of stopping the machine when the consumption deviates too far from a reference value, with consequent sizing errors.

The reference value is usually calculated by way of a preliminary learning procedure, during which a sample garment that conforms to the specifications is produced.

For some applications that are intrinsically less subject to sizing errors (e.g., the production of socks by way of small-diameter circular machines), the control system of the consumption of yarn can still be used to detect any anomalies that involve very small variations in consumption, such as the breakage of the needles of the machine.

It has in fact been found in practice that, by setting the intervention threshold to very low percentage values (in the order of 0.3-1% variation in consumption), the system is capable of detecting the breakage of even a single needle.

A drawback of this system for detecting anomalies is that, as is known, the measurement of the consumption of yarn is intrinsically subject to drift slowly over a period of hours (e.g., variations of 0.1 per thousand every hour), with consequent stoppages due to "false alarms" after a few hours of operation. In order to prevent such unjustified stoppages, it is therefore necessary to periodically stop the plant and repeat the learning procedure, at the expense of productivity.

SUMMARY

Therefore, the main aim of the present disclosure is to provide a method for controlling the consumption of yarn in a weaving process that allows to detect any anomalies, such as the breakage of needles, with high precision and without being influenced by the phenomenon of drift in the measurement of the consumption of yarn, so as to prevent stoppages owing to false alarms.

BRIEF DESCRIPTION OF THE DRAWINGS

Now the disclosure will be described in greater detail, with reference to a preferred but not exclusive embodiment thereof, which is illustrated for the purposes of non-limiting example in the accompanying drawings, wherein.

DETAILED DESCRIPTION OF THE DRAWINGS

Figure 1:
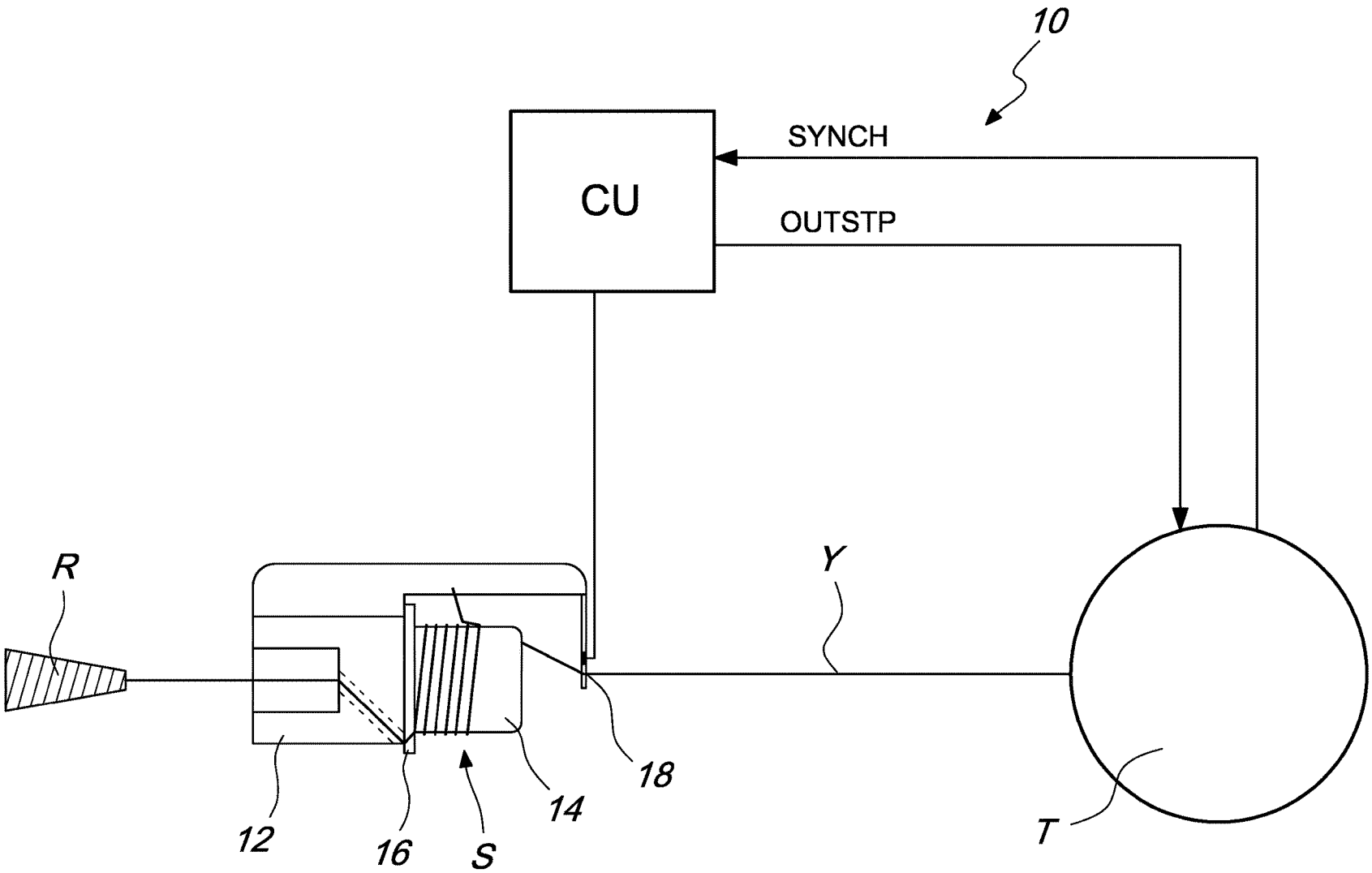
FIG. 1 is a schematic view of an accumulator weft feeder feeding a downstream generic textile machine.
Figure 2:
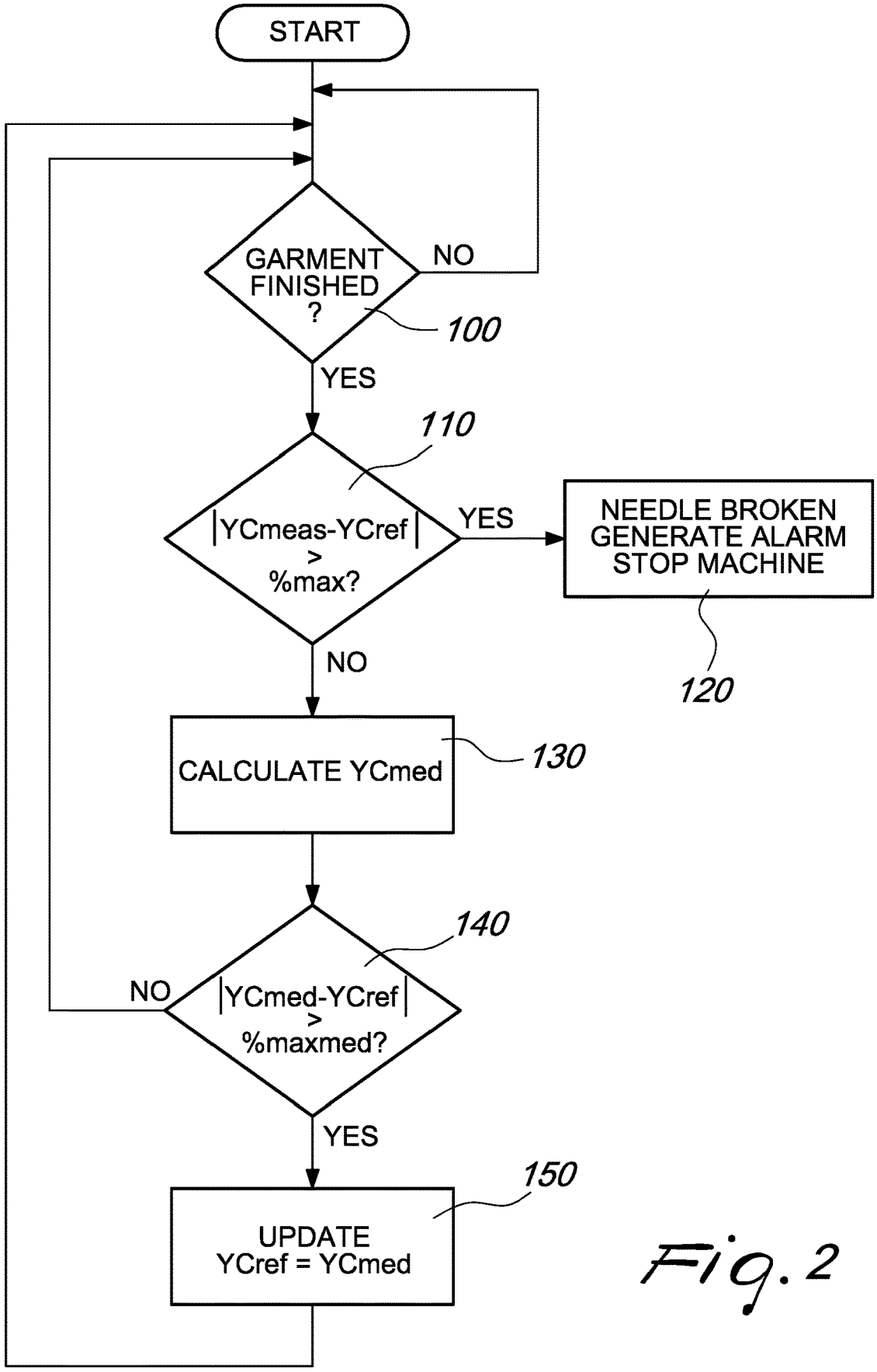
FIG. 2 is a flowchart showing the steps of the method according to the disclosure.

With reference to FIGS. 1 and 2, a generic textile apparatus 10 can comprise a plurality of feeders 12, which are adapted to give respective yarns Y to a downstream generic textile machine, e.g., a knitting machine T.

In the example described herein, the feeders are of the "accumulator" type. As is known, a generic accumulator feeder comprises a drum 14 that supports a plurality of turns of the wound yarn which form a reserve S. According to the type of feeder, as the yarn Y is taken by the machine T, the reserve can be topped up either by a flywheel that rotates in the manner of a swivel 16, which takes the yarn from an upstream distaff R and rewinds it onto the drum 14, as in the example shown here, or by rotating the drum which, therefore, in this case, must be motorized.

The apparatus described herein is furthermore provided with a system for controlling the consumption of yarn.

In this regard, in a per se known manner, the feeder 12 is provided with at least one unwinding sensor 18, typically an optical sensor, which generates an unwinding pulse for each yarn loop that is unwound from the drum at the request of the machine T. Although for the sake of simplicity only one unwinding sensor 18 is shown, it is understood that, for a more exact measuring, there can be multiple optical sensors, so as to detect the unwinding of fractions of a turn instead of full turns.

A control unit CU of the feeder 12 calculates the amount of yarn consumed for the production of each individual garment, henceforth measured consumption value YCmeas, on the basis of the number of unwinding pulses Npulses that are generated during the production of the garment, according to the formula:

$$YC\text{meas}=N\text{pulses}\times\Delta C,$$

where ΔC is the length of the turn (or fraction of a turn if multiple sensors are present).

The start and the end of the garment is indicated by respective synchronization signals SYNCH which are generated by the machine T. The measured consumption value YCmeas is set to zero at the start of the production of the garment, and then periodically updated on the basis of the above equation.

The system for controlling the consumption of yarn described above is capable of detecting any anomalies that involve a limited variation in consumption, such as the breakage of the needles of the machine T, to which henceforth reference will be made for the sake of simplicity.

The method for detecting the breakage of the needles is shown in the flowchart in FIG. 2.

In particular, once the garment is finished and the corresponding synchronization signal SYNCH has been received (block 100), the measured consumption value YCmeas is frozen and compared with a reference consumption value Ycref (block 110).

The reference consumption value can be determined by way of a preliminary learning procedure, during which a sample garment that conforms to the specifications is produced.

If the difference between the measured consumption value YCmeas and the reference consumption value YCref is greater than a limit value % max that indicates the breakage of a needle, the control unit CU generates an alarm and sends a stop signal OUTSTP to the machine T, which as a consequence is stopped (block 120).

% max is typically a percentage value comprised between 0.3-1%.

As is known, the measurement of the consumption of yarn is subject to drift slowly over a period of hours.

In order to make the system immune to false alarms arising from this circumstance, the method according to the disclosure periodically carries out the following steps:

calculate an average consumption value YCmed with respect to a preset number of already-finished garments (block 130), and compare the average consumption value YCmed with the reference consumption value YCref (block 140) and, if the difference (absolute value) is greater than a preset threshold value % maxmed, reset the reference consumption value YCref to the average consumption value YCmed (block 150).

The above steps are carried out periodically and, preferably, at the end of each garment, except where the garment just finished is the learning garment or one of the first Nmed-1 garments after the machine T has been started.

To overcome such limitation, advantageously a memory buffer can be initialized to a value equal to the reference consumption value YCref.

Furthermore, to calculate the average consumption value YCmed preferably the last Nmed garments are considered, where Nmed is a number advantageously comprised between 1 and 10, more advantageously between 3 and 10.

In the preferred embodiment described herein, the average consumption value YCmed is calculated by way of the formula:

$$YCmed = \frac{\sum_{n=1}^{n=Nmed} YCmeas_n}{Nmed}$$

where $YCmeas_n$ is the measured consumption value on the nth garment.

The threshold value % maxmed can be advantageously a percentage value, and should be a lower value than the limit value % max but greater than the ratio between the limit value % max and Nmed, according to the formula:

$$\%\max > \%\ maxmed > \frac{\%\ \max}{Nmed}$$

This prevents the reference value from being erroneously updated if the measured consumption value YCmeas, for accidental reasons, should temporarily reach a value which is proximate to the limit value % max.

A preferred embodiment of the disclosure has been described, but obviously the person skilled in the art may make various modifications and variations within the scope of protection of the claims.

In particular, the average consumption value YCmed, instead of being given by the arithmetic mean of the consumption values of the last Nmed garments, could be obtained differently, e.g., by way of a low-pass digital filter.

Furthermore, instead of calculating the average consumption value using all the last Nmed garments, it is possible to use only some of them, e.g., the last, the third last, the fifth last etc., at regular intervals or according to another preestablished scheme.

Also, the steps of calculating the average consumption value YCmed and of comparing the average consumption value YCmed with the reference consumption value YCref could be carried out only on some garments at regular intervals, instead of at the end of every garment.

Furthermore, although in the embodiment described herein reference has always been made to accumulator weft feeders, the disclosure can likewise be applied to "positive" weft feeders, in which the yarn is wound onto a motorized spool that, as it rotates, actively gives the yarn to the textile machine downstream. In this case, the consumption can be calculated on the basis of the position signals of the motor on which the spool is keyed.

Obviously the method according to the disclosure could be positively used to detect anomalies other than the breakage of the needles, e.g., yarn count errors or other anomalies that involve very small variations in consumption with respect to variations associated, e.g., with sizing errors.

The invention claimed is:

1. A method for controlling the consumption of yarn in a weaving process, wherein a textile machine receives a plurality of yarns from respective feeders each provided with a control unit, said control unit being adapted to calculate, for each garment produced, the amount of yarn consumed (YCmeas), compare it with a reference consumption value (YCref) and, if the difference is greater than a preset limit value (% max) that indicates an anomaly, generate an alarm, wherein said control unit periodically carries out the following steps:

calculating an average consumption value (YCmed) on the basis of a preset number (Nmed) of already-finished garments, and comparing said average consumption value (YCmed) with said reference consumption value (YCref) and, if the difference is greater than a preset threshold value (% maxmed), setting said reference consumption value (YCref) to said average consumption value (YCmed).

2. The method according to claim 1, wherein said steps are carried out at the end of each garment.

3. The method according to claim 1, wherein said average consumption value (YCmed) is given by the formula:

$$YCmed = \frac{\sum_{n=1}^{n=Nmed} YCmeas_n}{Nmed}$$

where $YCmeas_n$ is the consumption measured on the n-th garment and Nmed is said preset number of already-finished garments.

4. The method according to claim 3, wherein said average consumption value (YCmed) is calculated on the basis of the last Nmed already-finished garments.

5. The method according to claim 4, wherein said preset number is comprised between 1 and 10.

6. The method according to claim 4, wherein said preset number is comprised between 3 and 10.

7. The method according to claim 1, wherein said threshold value (% maxmed) is comprised between said preset limit value (% max) and a value that is equal to a ratio between the limit value (% max) and said preset number.

8. The method according to claim 1, wherein said feeders are an "accumulator" type and are each provided with an unwinding sensor that is adapted to generate an unwinding pulse at each passage of yarn that is unwound from the drum, and in that the control unit calculates said amount of yarn consumed (YCmeas) on the basis of the formula:

$$YC\text{meas}=N\text{pulses}\times\Delta C,$$

where Npulses is the number of pulses generated and ΔC is the length of yarn comprised between two successive pulses.

* * * * *